United States Patent [19]

Seidinger

[11] Patent Number: 4,913,218

[45] Date of Patent: Apr. 3, 1990

[54] FEEDER SPRUE SYSTEM FOR A CASTING MOLD

[75] Inventor: Karl Seidinger, Volkartshausen, Fed. Rep. of Germany

[73] Assignee: Georg Fischer AG, Schaffhausen, Switzerland

[21] Appl. No.: 310,320

[22] Filed: Feb. 13, 1989

[30] Foreign Application Priority Data

Feb. 12, 1988 [CH] Switzerland ..... 00527/88

[51] Int. Cl.[4] ..... B22C 9/08

[52] U.S. Cl. ..... 164/358; 164/364

[58] Field of Search ..... 164/358, 359, 360, 349, 164/362, 364

[56] References Cited

U.S. PATENT DOCUMENTS

| | | | |
|---|---|---|---|
| 825,090 | 7/1906 | Turner | 164/358 |
| 1,049,877 | 1/1913 | Lange | 164/359 |
| 1,657,952 | 1/1928 | Zoda | 164/358 |

*Primary Examiner*—Richard K. Seidel

*Attorney, Agent, or Firm*—Bachman & LaPointe

[57] ABSTRACT

A casting mold having first and second casting mold halves is provided with a sprue system in the first casting mold half which comprises a sprue casting mold half which comprises a sprue cup for receiving molten metal and feeding same to a feeder provided with a filter which filters the molten metal prior to delivering same to a mold cavity provided in the second casting mold half.

12 Claims, 3 Drawing Sheets

FEEDER SPRUE SYSTEM FOR A CASTING MOLD

BACKGROUND OF THE INVENTION

The present invention relates to a feeder sprue system for a casting mold having at least one mold cavity and more particularly a sprue system for a casting mold having first and second casting mold halves.

During the filling of a cast mold, molten metal is fed to the mold cavity via a sprue system. The purpose of the sprue system is to control and guide the flow of the molten metal in order to avoid turbulence thus allowing the entire mold cavity to be filled in the best possible manner. Excess turbulence will result in inclusions in the final cast product. After the mold cavity has been filled with molten metal, it is an intended purpose of the sprue system to provide enough molten metal to top the casting or at the least to assist in topping the casting.

In designing a sprue system particular care must be taken to insure on the one hand that the molten metal is maintained at necessary temperatures when the mold cavity is being filled and on the other hand to avoid the passing of harmful inclusions such as slag, oxides or the like into the mold cavity. Failure to obtain both of the foregoing design parameters results in inferior cast products.

The amount of circulating molten metal is directly proportional to the volume of the total sprue system. There have been many designs in the past for sprue systems. While the sprue systems currently used produce, as a rule, good castings, they suffer from a number of economic disadvantages as pointed out hereinbelow. Firstly, in the sprue system designs presently employed a relatively high proportion of metal remains in the sprue system. In addition, the space requirements for casting molds presently used are relatively large in light of the fact that the casting mold includes not only the mold cavities but also involves pouring systems with slag runners and the like. Finally, after casting, when using present systems, the circulating molten metal must be removed from the sprue system which represents a substantial cost factor.

Accordingly, it is the principal object of the present invention to provide a feeder sprue system for a casting mold which insures high quality castings, short filling times and, is at the same time economical.

SUMMARY OF THE INVENTION

The foregoing object is achieved by way of the present invention wherein a casting mold comprises first and second casting mold halves. The first casting mold half has a molten metal inlet to a sprue system and the second casting half includes at least one mold cavity. The sprue system communicates molten metal from the inlet thereof to the mold cavity or cavities as the case may be. In accordance with a specific feature of the present invention, the sprue system comprises a sprue cup in the first casting mold half for receiving molten metal from the molten metal inlet and a feeder is located in the first casting mold half downstream of the sprue cup for delivering molten metal to the mold cavity in the second mold half. In accordance with a particular feature of the present invention, the feeder is located in a recess provided in the first casting mold half and forms with the first casting mold half part of the boundary surface between the first casting mold half and the second casting mold half. In accordance with a further feature of the present invention, the feeder is provided with a filter for filtering all the molten metal prior to delivering the molten metal to the mold cavity. The filter may be located in the feeder on the sprue side thereof or on the mold cavity side thereof. The sprue cup may be formed separate from or integral with the feeder. By providing a system as set forth above, high quality castings are produced employing short filling times in an economic manner.

Further objects and advantages will appear hereinbelow.

DETAILED DESCRIPTION

Figure 1:
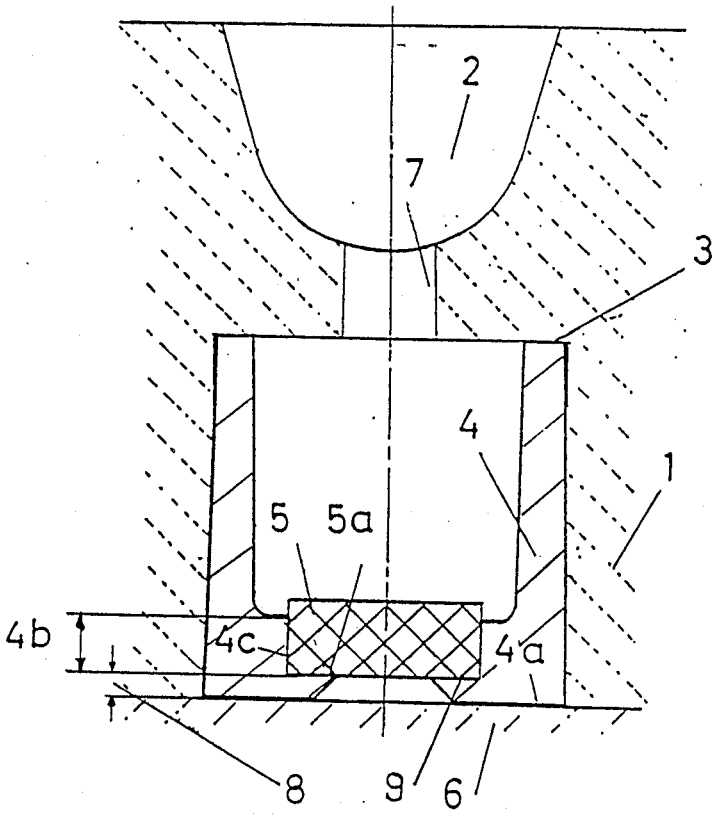
FIG. 1 shows a section through a feeder sprue system according to the present invention.

With reference to the drawings, a casting mold comprises a first mold half 1 and a second mold half 6. A sprue cup 2 is provided in the first casting mold half 1. The sprue cup may be molded into the casting mold 1, cut therein or introduced in any other known manner. With reference to FIG. 1, a connecting channel 7 connects the sprue cup 2 with a recess 3 provided in the casting mold half 1. The recess 3 opens to the second mold half 6 which includes at least one mold cavity, not shown. The recess 3 receives a feeder and is sized accordingly. The feeder may be in the form of a hollow cylindrical member or the like and communicates the sprue cup 2 with the mold cavity in the second mold half 6. The hollow feeder 4 has a conduit which is provided with a constriction **4*c* having a height 4*b* in which a filter element 5 is positioned. The filter is fitted in the constriction 4*c* in such a manner as to insure that all the molten metal fed to the mold cavity in the second mold half 6** passes through the filter element.

As can be seen from FIG. 1, the surface **4*a* of the feeder 4 forms with the first casting mold half 1 the boundary surface between casting mold half 1 and casting mold half 6. The bottom surface 5*a* of filter element 5 rests on a flange 9 formed on the feeder 4 so as to insure that the filter element 5 is set back a distance 8 from the boundary surface between mold cavity halves 1 and 6**. This arrangement insures easy removal of the feeder after solidification.

Figure 2:
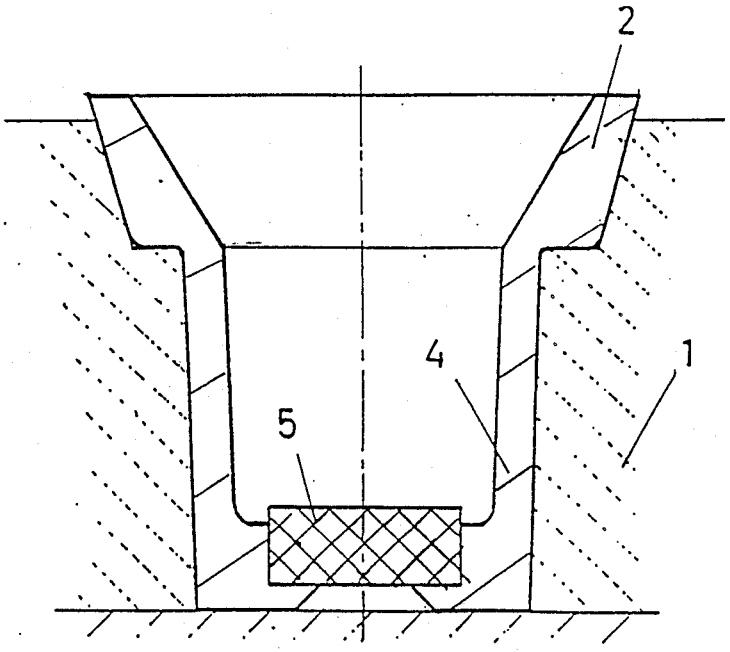
FIG. 2 shows a second embodiment of a feeder sprue system in accordance with the present invention.

FIG. 2 shows a second embodiment of a sprue system in accordance with the present invention. In this embodiment, the sprue cup is produced integrally with the feeder 4 and is introduced into an opening provided in the mold half 1. The filter 5 is arranged in the feeder 4 in the same manner as described in FIG. 1.

Figure 3:
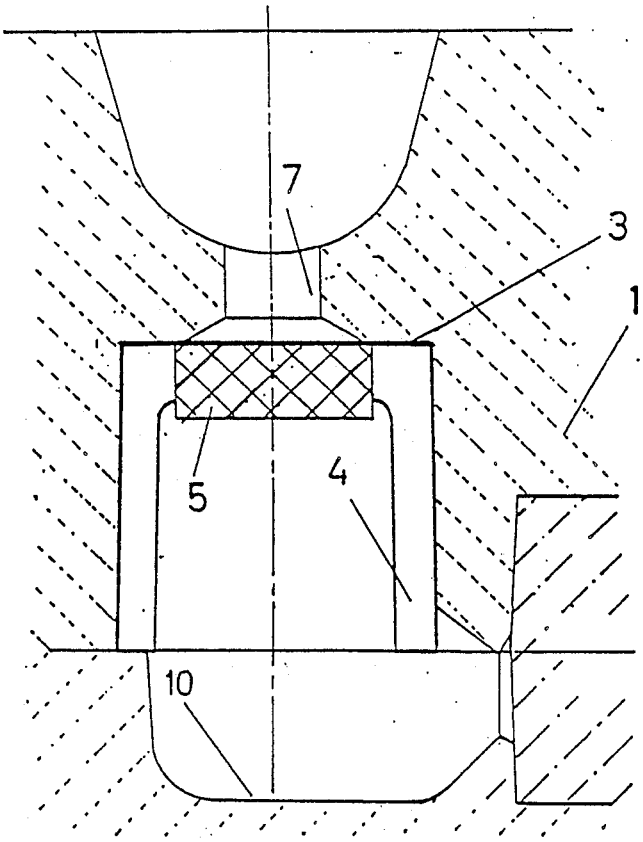
FIG. 3 shows a third embodiment of a feeder sprue system in accordance with the present invention.

FIG. 3 shows a third embodiment of a sprue system in accordance with the present invention in which the filter element is provided on the inlet side of the feeder. In this arrangement the connecting channel 7 feeds molten metal from the sprue cup 2 directly to the filter element 5. A recess 10 may be provided in the second mold half 6 which acts as an enlarged chamber for molten metal so as to allow feeding of molten metal from the side to a mold cavity.

When employing the sprue feeder system of the present invention the cast material is fed from the sprue cup to the feeder where the cast material is filtered prior to passing same to the mold cavity provided in the second mold half. After the end of the pouring step the cast material required for liquid contraction is taken directly from the sprue cup into the feeder through the feeder sprue system in order to supply material for topping the casting.

The system of the present invention offers the following advantages. There is an increase in casting throughput. The material required for topping the casting is taken directly from the sprue cup. Lower casting temperatures are possible as a result of the small temperature losses due to the short filling paths. Finally, there is no expensive guide system.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

I claim:

1. A casting mold comprising a first casting mold half having a molten metal inlet and a sprue system and a second casting mold half having at least one mold cavity wherein said sprue system communicates said molten metal inlet with said at least one mold cavity, said sprue system comprises a sprue cup in said first casting mold half downstream of said molten metal inlet for receiving molten metal and a feeder located in said first casting mold half downstream of said sprue for delivering molten metal to said at least one mold cavity in said second casting mold half said feeder comprises a conduit portion and a separate filter portion, said conduit portion having an inlet for receiving molten metal from said sprue cup and an outlet for passing said molten metal to said at least one mold cavity wherein said conduit is provided with a constriction upstream of said outlet and said filter portion is fitted in said constriction so as to insure all molten metal passes through the filter.

2. A casting mold according to claim 1 wherein said feeder is located in a recess in said first casting mold half and forms part of a boundary surface between the first casting mold half and the second casting mold half.

3. A casting mold according to claim 2 wherein a connecting channel communicates said sprue cup with said feeder.

4. A casting mold according to claim 2 wherein said sprue cup and said feeder are integral with each other and located in a recess in said first casting mold half.

5. A casting mold according to claim 2 wherein said sprue cup is formed in said first casting mold half.

6. A casting mold according to claim 2 wherein said casting mold is a sand mold.

7. A casting mold according to claim 2 wherein said casting mold is a permanent mold.

8. A casting mold according to claim 2 wherein said casting mold consists of ceramic.

9. A casting mold according to claim 1 wherein said constriction is located adjacent said sprue cup.

10. A casting mold according to claim 1 wherein said constriction is located adjacent the second casting mold half.

11. A casting mold according to claim 10 wherein said constriction and filter are set back from the boundary surface.

12. A casting mold according to claim 1 wherein said conduit portion is provided with a flange downstream of said constriction for supporting the filter portion within the constriction.

* * * * *